US010232664B2

(12) United States Patent
Salimi

(10) Patent No.: US 10,232,664 B2
(45) Date of Patent: Mar. 19, 2019

(54) GEOMETRIC DIVIDER

(71) Applicant: Hojjatollah Salimi, Hamedan (IR)

(72) Inventor: Hojjatollah Salimi, Hamedan (IR)

( * ) Notice: Subject to any disclaimer, the term of this patent is extended or adjusted under 35 U.S.C. 154(b) by 144 days.

(21) Appl. No.: 15/430,539

(22) Filed: Feb. 13, 2017

(65) Prior Publication Data

US 2018/0229542 A1 Aug. 16, 2018

(51) Int. Cl.

*B43L 13/22* (2006.01)
*B43L 9/10* (2006.01)
*B43L 13/20* (2006.01)

(52) U.S. Cl.

CPC ..... *B43L 13/205* (2013.01); *B43L 9/10* (2013.01)

(58) Field of Classification Search

CPC .. B43L 7/10; B43L 11/00; B43L 13/10; B43L 13/14; B43L 13/20; B43L 13/201; B43L 13/203; B43L 13/205

USPC .... 33/1 K, 18.3, 23.09, 25.1, 454, 455, 456, 33/459, 460, 558.01, 562, 663, 664, 665, 33/558.02

See application file for complete search history.

(56) References Cited

U.S. PATENT DOCUMENTS 441,909 A * 12/1890 Walkup ..... B43L 13/10 33/25.2
1,452,828 A * 4/1923 Deitz ..... B43K 23/001 33/664
1,872,578 A * 8/1932 Hampton ..... B43L 13/144 33/456
2,510,805 A * 6/1950 Dewey ..... B43L 9/12 33/558.02
2,645,021 A * 7/1953 Dierkes ..... B43L 9/08 33/558.02
2,782,505 A * 2/1957 Guischard ..... B43L 13/10 33/25.1
5,472,029 A * 12/1995 Ketch ..... B23Q 9/0042 144/144.1
7,043,849 B1 * 5/2006 Leger ..... B43L 7/12 33/558.02
9,250,072 B2 * 2/2016 Levy ..... B43L 9/08

FOREIGN PATENT DOCUMENTS

DE 1800343 B1 * 7/1970 ..... B43L 9/08
GB 2234715 A * 2/1991 ..... B43L 7/005
JP 48027381 B * 8/1973 ..... B43L 13/14

* cited by examiner

*Primary Examiner* — Christopher W Fulton

(57) ABSTRACT

A geometric divider divides a dimension into equal portions. The geometric divider comprises multiple brachiums, a set of grooves on a first brachium and a second brachium, and multiple slots on at least two brachiums. A base brachium is pivotally connected to a first brachium and a second brachium. A third brachium is configured to slide across the grooves, and corresponding ends of each brachium define multiple mouthpieces to measure the dimension. Each slot is numbered, and a first mouthpiece defined by the base brachium and the first brachium is configured to enclose on the dimension. The third brachium is configured to be selectively pinned in a predetermined numbered slot to determine the number of equal portions to which the dimension is to be divided. An intersection of the third brachium on the dimension divides the dimension to generate a first portion of the equal portions of the dimension.

12 Claims, 5 Drawing Sheets

Related Art

GEOMETRIC DIVIDER

BACKGROUND OF THE INVENTION

In many jobs related to drawings, preselected patterns and templates are of great importance. When such patterns or templates are to be created, or when there is a need for a new artistic work to be done, the location of correct sizes, distances and proportions are inevitable. From another point of view, based on the industry as well as art, the basis of geometrical designing from a technical perspective has always been depended on designing using hands.

However, the professional experiences of the skilled personnel involved in such jobs show that, despite software advancements in the designing field, it is the artistry and technical drawing skills of a designer that finishes a work to its best potential. However, after the work is done using hands, it is delivered to software such as CorelDraw®, AutoCAD®, etc. to make it presentable.

As known in the art, one of the most distinctive instances of the creation of templates or patterns is evident in cultural and religious architecture, like polychrome tiles pattern designs, carpet designs, paintings on earthenware, and arts such as woodcarving, Plinth column, tile works and many techniques related to abstract or realistic designs. For example, in the architectural crafts in certain cultures, for drawing "The Arc Five And Nine" the mouthpiece of the chosen device is divided into twelve parts, or in drawing "Klyl Arc", one part out of six parts of the size of the mouthpiece is needed. To do this, the position on the sketch is selected on the basis of the individual's view point where the accuracy could be very low and the possibility of error is high.

On the other hand, in other drawings, it is necessary to measure the line accurately based on a millimeter scale, and then the line is calculated and divided by a calculator, and finally it is graded in the required positions. Another method of dividing a line segment is by traditional method using a compass to mark and draw the parallel lines. Yet another method is to use the Fibonacci golden proportions in various designs of motifs, shapes, plans and façade, etc.

Another one of the major demands of most designers is to mechanize parts of the job which are being repeated. This is because repetition requires time and energy, especially for the activities which require tools such as rulers and calculators. In drawings performed in industrial and artistic drafts, for creating patterns or illustrations, determining the proportions of objects and the proportions of distances between objects is very important. More important than that is the tool that can determine these activities quickly and accurately.

The different methods mentioned above which involve different stages of calculations help the workers or artists to improve their work to a certain extent. However, such stages require time and energy and more importantly the degree of error might be higher. Therefore, there is a requirement for a tool which can perform such tasks quickly and accurately so that the process accelerates the creation of artistic works in such industries. There is a need for a single tool which can readily divide any distance into equal number of parts through repetitive usage, where the distance is divided to the desired proportions. A tool which the designers can use to produce drawing processes step by step, as precise and fast as any conventionally available softwares for a variety of patterns, and further providing a learning process for the designers regarding such geometrical patterns.

SUMMARY OF THE INVENTION

This summary is provided to introduce a selection of concepts in a simplified form that are further disclosed in the detailed description of the invention. This summary is not intended to identify key or essential inventive concepts of the claimed subject matter, nor is it intended for determining the scope of the claimed subject matter.

The geometric divider is configured to divide a dimension into equal portions. The geometric divider comprises multiple brachiums, a set of grooves on a first brachium and a second brachium, and multiple slots positioned on the first groove and the second groove. A base brachium is pivotally connected to a first brachium at a first pivot and to a second brachium at a second pivot. The first groove is positioned on the first brachium, and the second groove on the second brachium. A third brachium is configured to slide across the first groove and the second groove, and corresponding distal ends of each brachium define multiple mouthpieces configured to measure the dimension.

Each slot is numbered in arithmetic progression, and a first mouthpiece defined by distal ends of the base brachium and the first brachium is configured to enclose on the dimension. The third brachium is configured to be selectively pinned in a predetermined numbered slot on the first groove and the second groove, and the predetermined numbered slot determines the number of equal portions to which the dimension is to be divided. An intersection of the third brachium on the dimension divides the dimension to generate a first portion of the equal portions of the dimension.

In an embodiment, a distance between the base brachium and the intersection of the third brachium on the dimension defines a second mouthpiece, and the second mouthpiece is configured to generate a length of the first portion of the equal portions to which the dimension is to be divided. In an embodiment, the geometric divider further comprises an intermediate linkage member configured to connect the first brachium and second brachium proximal to each distal end of the first brachium and second brachium.

In an embodiment, each brachium comprises one or more curved edges, and each curved edge is configured to be used by an artist to draw arced edges or arced surfaces. In an embodiment, geometric divider further comprises a third mouthpiece defined between distal ends of first brachium and second brachium, and a fourth mouthpiece defined between distal ends of the second brachium and the third brachium. The distances of the third mouthpiece and the first mouthpiece are configured to be in a golden proportion.

As used herein, 'golden proportion' refers to a unique ratio also known as the divine proportion, golden mean, or golden section, which is a number often encountered when taking the ratios of distances in simple geometric figures such as the pentagon, pentagram, decagon and dodecahedron. In an embodiment, the positioning of the third mouthpiece along a length of the dimension generates a golden complement at the first mouthpiece, where the golden complement is a maximally opposing complement of the golden proportion. In another embodiment, the positioning of the third mouthpiece along a length of the dimension generates a golden complement at the fourth mouthpiece, where the golden complement is a maximally opposing complement of the golden proportion.

In one aspect, the present disclosure is directed to a geometric divider configured to divide a dimension into equal portions, geometric divider comprising: (a) a plurality of brachiums, a base brachium pivotally connected to a first brachium at a first pivot and to a second brachium at a second pivot; (b) a first groove positioned on the first brachium, and a second groove on the second brachium, wherein a third brachium is configured to slide across the first groove and the second groove, wherein corresponding distal ends of each brachium define a plurality of mouthpieces configured to measure the dimension; and (c) a plurality of slots positioned on the first groove and the second groove, each slot numbered in arithmetic progression, wherein a first mouthpiece defined by distal ends of the base brachium and the first brachium is configured to enclose on the dimension, and the third brachium is configured to be selectively pinned in a predetermined numbered slot on the first groove and the second groove, wherein the predetermined numbered slot determines the number of equal portions to which the dimension is to be divided, and an intersection of the third brachium on the dimension divides the dimension to generate a first portion of the equal portions of the dimension.

In one embodiment of the geometric divider, a distance between the base brachium and the intersection of the third brachium on the dimension defines a second mouthpiece, wherein the second mouthpiece is configured to generate a length of the first portion of the equal portions to which the dimension is to be divided. In another embodiment, the geometric divider further comprises an intermediate linkage member configured to connect the first brachium and second brachium proximal to each distal end of the first brachium and second brachium. In one embodiment, each brachium comprises one or more curved edges, wherein each curved edge is configured to be used by an artist to draw one of arced edges and arced surfaces.

In one embodiment, the geometric divider further comprises a third mouthpiece defined between distal ends of first brachium and second brachium, and a fourth mouthpiece defined between distal ends of the second brachium and the third brachium, wherein distances of the third mouthpiece and the fourth mouthpiece are configured to be in a golden proportion. In a related embodiment, the positioning of the third mouthpiece along a length of the dimension generates a golden complement at the fourth mouthpiece, wherein the golden complement is a maximally opposing complement of the golden proportion.

Another aspect of the present disclosure is directed to a method to divide a dimension into equal portions, the method comprising: (a) providing a geometric divider, comprising: (i) a plurality of brachiums, a base brachium pivotally connecting to a first brachium at a first pivot and to a second brachium at a second pivot; (ii) a first groove positioned on the first brachium, and a second groove on the second brachium, wherein a third brachium is configured to slide across the first groove and the second groove, wherein corresponding distal ends of each brachium define a plurality of mouthpieces configured to measure the dimension; and (iii) a plurality of slots positioned on the first groove and the second groove, each slot numbered in arithmetic progression; (b) enclosing a first mouthpiece defined by distal ends of the base brachium and the second brachium on the dimension; (c) selectively pinning the third brachium in a predetermined numbered slot on the first groove and the second groove, wherein the predetermined numbered slot determines the number of equal portions to which the dimension is to be divided; and (d) dividing the dimension via an intersection of the third brachium on the dimension to generate a first portion of the equal portions of the dimension.

In one embodiment, the method further comprises defining a second mouthpiece between the base brachium and the intersection of the third brachium on the dimension, wherein the second mouthpiece is configured to generate a length of the first portion of the equal portions to which the dimension is to be divided. In another embodiment, the method further comprises an intermediate linkage member configured to connect the first brachium and second brachium proximal to each distal end of the first brachium and second brachium. In one embodiment, each brachium comprises one or more curved edges, wherein each curved edge is configured to be used by an artist to draw one of arced edges and arced surfaces.

In another embodiment, the method further comprises a third mouthpiece defined between distal ends of first brachium and second brachium, and a fourth mouthpiece defined between distal ends of the second brachium and the third brachium, wherein distances of the third mouthpiece and the first mouthpiece are configured to be in a golden proportion. In a related embodiment, the method further comprises positioning the third mouthpiece along a length of the dimension to generate a golden complement at the first mouthpiece, wherein the golden complement is a maximally opposing complement of the golden proportion.

BRIEF DESCRIPTION OF THE DRAWINGS

The foregoing summary, as well as the following detailed description of the invention, is better understood when read in conjunction with the appended drawings. For the purpose of illustrating the invention, exemplary constructions of the invention are shown in the drawings. However, the invention is not limited to the specific methods and components disclosed herein.

DETAILED DESCRIPTION

The present invention generally relates to a device used in dividing drawing segments in the field of fine arts, and more particularly relates to a geometric divider configured to divide a dimension into equal portions. For example, in the architectural crafts in certain cultures, for drawing "The Arc Five And Nine" the mouthpiece of the chosen device is divided into twelve parts, or in drawing "Klyl Arc", one part out of six parts of the size of the mouthpiece is needed. To do this, there have, inter alia, three solutions: 1—the position on the sketch is selected on the basis of the individual's view point where the accuracy could be very low and the possibility of error is high; 2—the line is calculated and divided by a calculator, and finally it is graded in the positions where it is necessary to measure the line accurately based on millimeter scale; and 3—another method of dividing a line segment is by a traditional method using a compass to mark and draw the parallel lines. Another usage of this invention is the Fibonacci golden proportions in various designs of motifs, shapes, plans and façade, etc.; this usage is installed on the right side of the tool.

Figure 1:
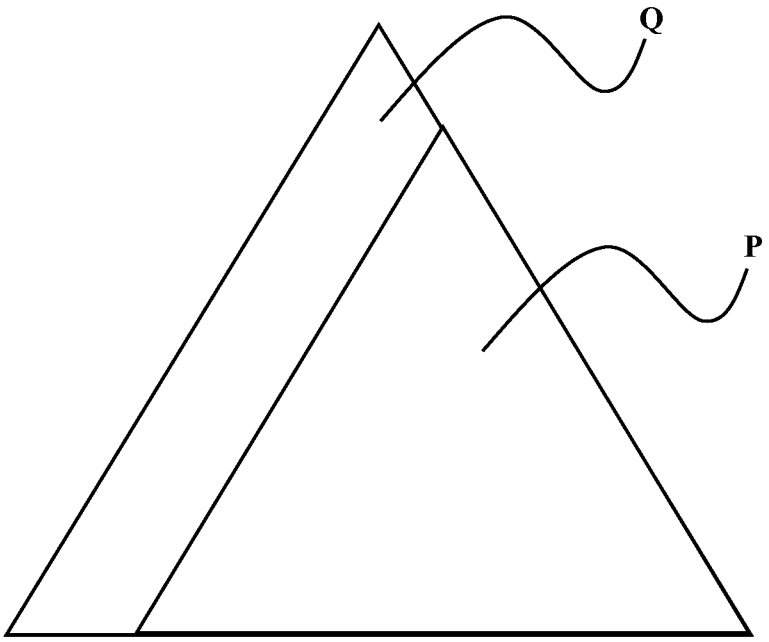
FIG. 1 exemplarily illustrates a first triangle P positioned within a second triangle Q to describe the principle of working of the geometric divider.

FIG. 1 exemplarily illustrates a first triangle P positioned within a second triangle Q to describe the principle of working of the geometric divider 100. By using the rules governing parallel lines and trigonometric similarity in geometry, it is possible to explain working principles of the geometric divider 100. In an example, if one wants to divide a line segment into 7 equal parts, one can proceed to covert the line segment into a desired triangle with two predetermined sides. Therefore, a user will derive a triangle with two determined sides, and one unknown angle but with congruency. Then, another triangle is prepared similar to the previous one and proportional with the determined sides of the previous triangle, for example, $1/7^{th}$ of the previous triangle. Therefore, by performing this, the unknown angle becomes congruent. Here, this angle is also transferred to the adjoining side via parallel lines. Finally, when the user places the triangles P and Q on the intended line segment, the size obtained from the third side of the similar triangle, or the third side of the second triangle Q, will have dimensions equal to 1/7 times of the first triangle P.

In other words, as shown in FIG. 1, the rules governing parallel lines and trigonometric similarity are used in such a way that, the two triangles P and Q with predetermined proportions are always the basis for the distance or division of lines. As shown in FIG. 1, the triangle Q is multiplied by "X" times its dimension to obtain the triangle P. Thus, the base side of the triangle P is equal to "X" times the base side of the triangle Q. Other intended division amounts may be obtained by generalizing this method and multiplying the triangle Q in the desired numbers of X1, X2, X3, etc.

Figure 2A:
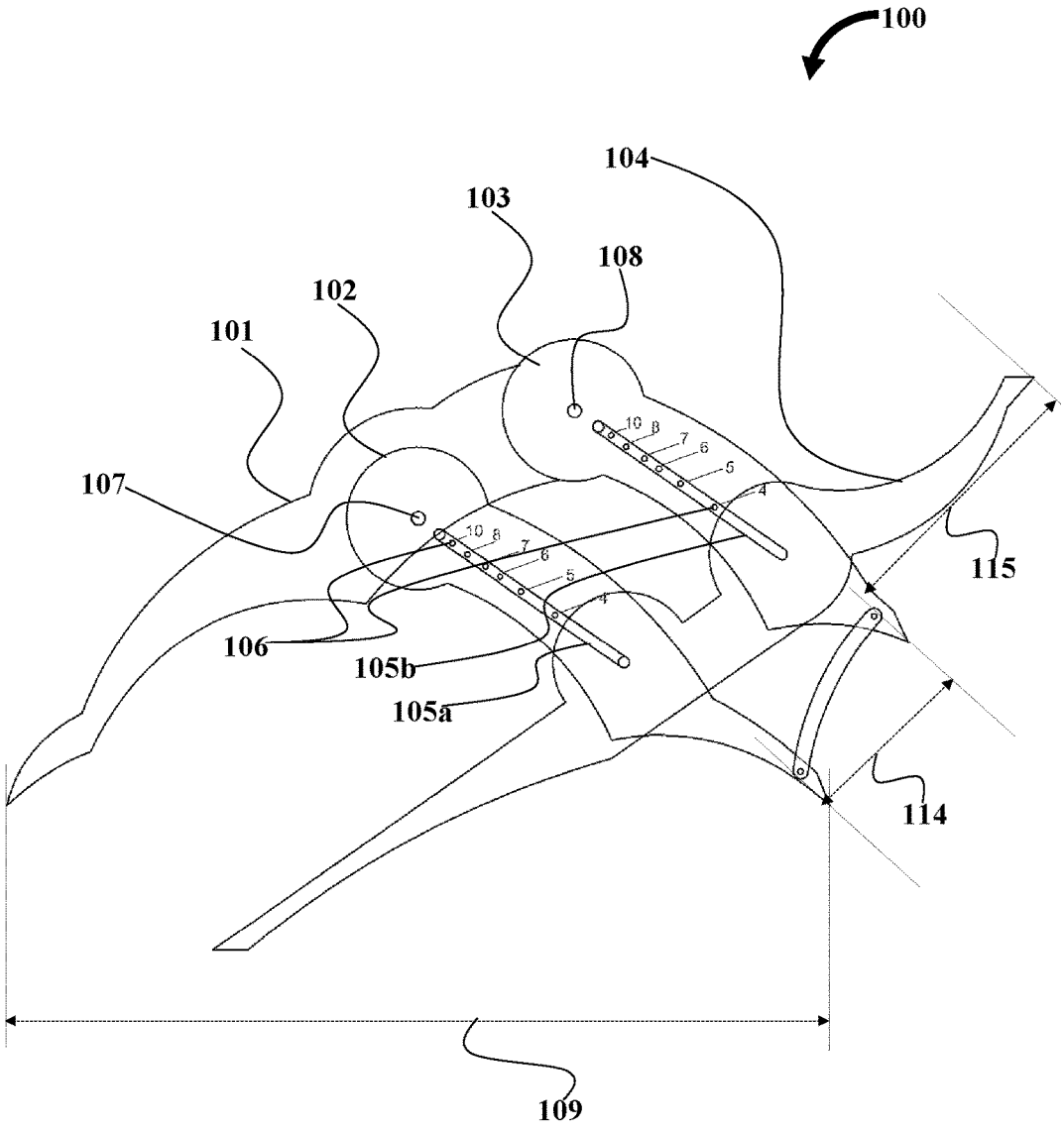
FIG. 2A exemplarily illustrates a front perspective view of the geometric divider.
Figure 2B:
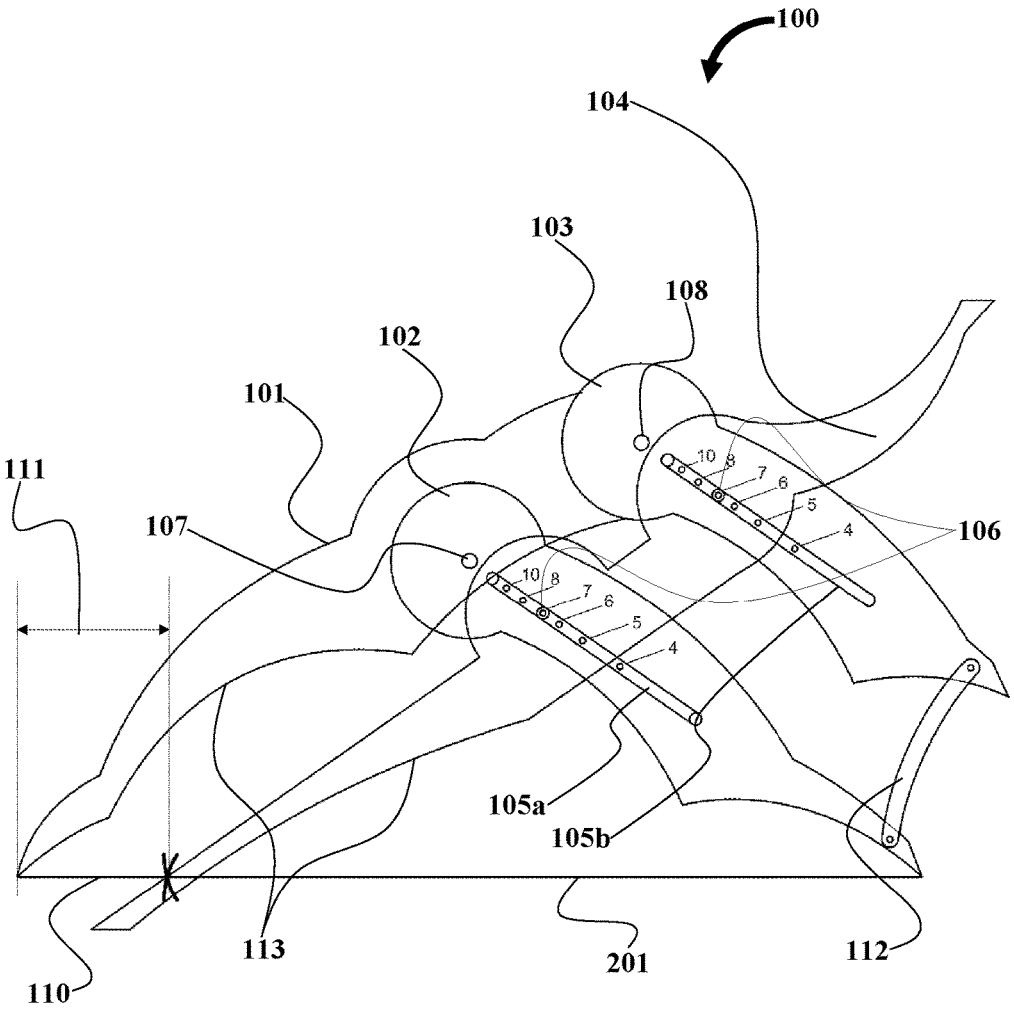
FIG. 2B exemplarily illustrates a front perspective view of the geometric divider used to measure a dimension.

FIG. 2A exemplarily illustrates a front perspective view of the geometric divider 100, and FIG. 2B exemplarily illustrates a front perspective view of the geometric divider 100 used to measure a dimension 201. The geometric divider 100 is configured to divide a dimension 201 into equal portions. The geometric divider 100 comprises multiple brachiums 101, 102, 103, and 104, a set of grooves 105*a* and 105*b* on a first brachium 102 and a second brachium 103, and multiple slots 106 positioned on the first groove 105*a* and the second groove 105*b*.

A base brachium 101 is pivotally connected to the first brachium 102 at a first pivot 107 and to a second brachium 103 at a second pivot 108. The first groove 105*a* is positioned on the first brachium 102, and the second groove 105*b* on the second brachium 103. A third brachium 104 is configured to slide across the first groove 105*a* and the second groove 105*b*, and corresponding distal ends of each brachium 101, 102, 103, and 104 define multiple mouthpieces configured to measure the dimension 201. Each slot 106 is numbered in arithmetic progression. In other words, each slot 106 on the first brachium 102 and the second brachium 103 are numbered in the order, for example, 2, 3, 4, 5, 6, 7, 8, and 9.

Referring to FIG. 2B, a first mouthpiece 109 defined by distal ends of the base brachium 101 and the first brachium 102 is configured to enclose on the dimension 201. The third brachium 104 is configured to be selectively pinned in a predetermined numbered slot 106, for example, '7' as shown in FIG. 2B, on the first groove 105*a* and the second groove 105*b*. The predetermined numbered slot 106 determines the number of equal portions to which the dimension 201 is to be divided. An intersection of the third brachium 104 on the dimension 201 divides the dimension 201 to generate a first portion 110 of the equal portions of the dimension 201.

In other words, as shown in FIG. 2B, the first mouthpiece 109 is opened to enclose on the size of the desired segment or dimension 201. The geometric divider 100 has brachiums 101, 102, 103, and 104, and the third brachium 104 is slidably aligned across the grooves 105*a* and 105*b*. The grooves 105*a* and 105*b* contain stop locations or slots 106 across the first brachium 102 and the second brachium 103, for example, slots 106 numbered in the sequence of 2, 3, 4, 5, 6, 7, 8, and 9. The order of calculating the division of a dimension 201 or any predefined distance is completed via the following procedure; after placing the third brachium 104 at the location H1 or '2', it divides the first mouthpiece 109 into half and shows it along a second mouthpiece 111, as discussed further. In another case, if the third brachium 104 is placed in H2 or '3'; the second mouthpiece 111 will equal to $1/3^{rd}$ of first mouthpiece 109 and at the same way will be 1/4, 1/5, 1/6, 1/7, 1/8, 1/9, 1/10 multiples of first mouthpiece 109.

As such, one aspect of the present disclosure is directed to a geometric divider configured to divide a dimension into equal portions. The geometric divider comprises a plurality of brachiums, a base brachium pivotally connected to a first brachium at a first pivot and to a second brachium at a second pivot; and a first groove positioned on the first brachium, and a second groove on the second brachium, wherein a third brachium is configured to slide across the first groove and the second groove, and wherein corresponding distal ends of each brachium define a plurality of mouthpieces configured to measure the dimension.

The geometric divider further comprises a plurality of slots positioned on the first groove and the second groove, each slot numbered in arithmetic progression, wherein a first mouthpiece defined by distal ends of the base brachium and the first brachium is configured to enclose on the dimension, and the third brachium is configured to be selectively pinned in a predetermined numbered slot on the first groove and the second groove, wherein the predetermined numbered slot determines the number of equal portions to which the dimension is to be divided, and an intersection of the third brachium on the dimension divides the dimension to generate a first portion of the equal portions of the dimension.

In an embodiment, a distance between the base brachium 101 and the intersection of the third brachium 104 on the dimension 201 defines the second mouthpiece 111, and the second mouthpiece 111 is configured to generate a length of the first portion 110 of the equal portions to which the dimension 201 is to be divided. In an embodiment, the geometric divider 100 further comprises an intermediate linkage member 112 configured to connect the first brachium 102 and second brachium 103 proximal to each distal end of the first brachium 102 and second brachium 103. The intermediate linkage member 112 constantly aligns the first brachium 102 and second brachium 103 along a specific distance from each other as per the positioning of the pivots 107 and 108.

In an embodiment, each brachium 101, 102, 103, and 104 comprises one or more curved edges 113, and each curved edge 113 is configured to be used by an artist to draw arced edges or arced surfaces. As shown in FIG. 2A, in an embodiment, the geometric divider 100 further comprises a third mouthpiece 114 defined between distal ends of first brachium 102 and second brachium 103, and a fourth mouthpiece 115 defined between distal ends of the second brachium 103 and the third brachium 104. The distances of the third mouthpiece 114 and the first mouthpiece 109 are configured to be in a golden proportion. In an embodiment, the positioning of the third mouthpiece 114 along a length of the dimension 201 generates a golden complement at the first mouthpiece 109, where the golden complement is a maximally opposing complement of the golden proportion. In one example, the distances of the third mouthpiece 114 and the fourth mouthpiece 115 are configured to be in a golden proportion. The positioning of the third mouthpiece 114 along a length of the dimension 201 can generate a golden complement at the fourth mouthpiece 115, where the golden complement is a maximally opposing complement of the golden proportion.

Figure 3A:
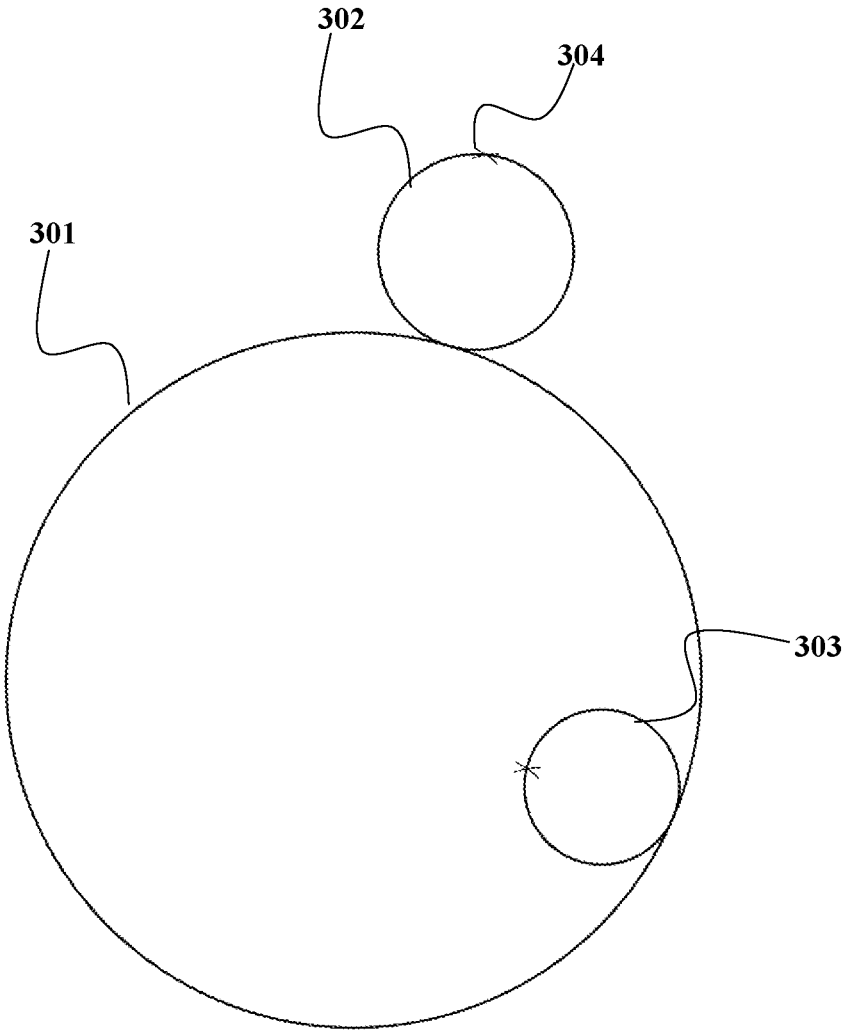
FIG. 3A exemplarily illustrates a working example of the geometric divider, showing the construction of an Eslimi snake design using circles.
Figure 3B:
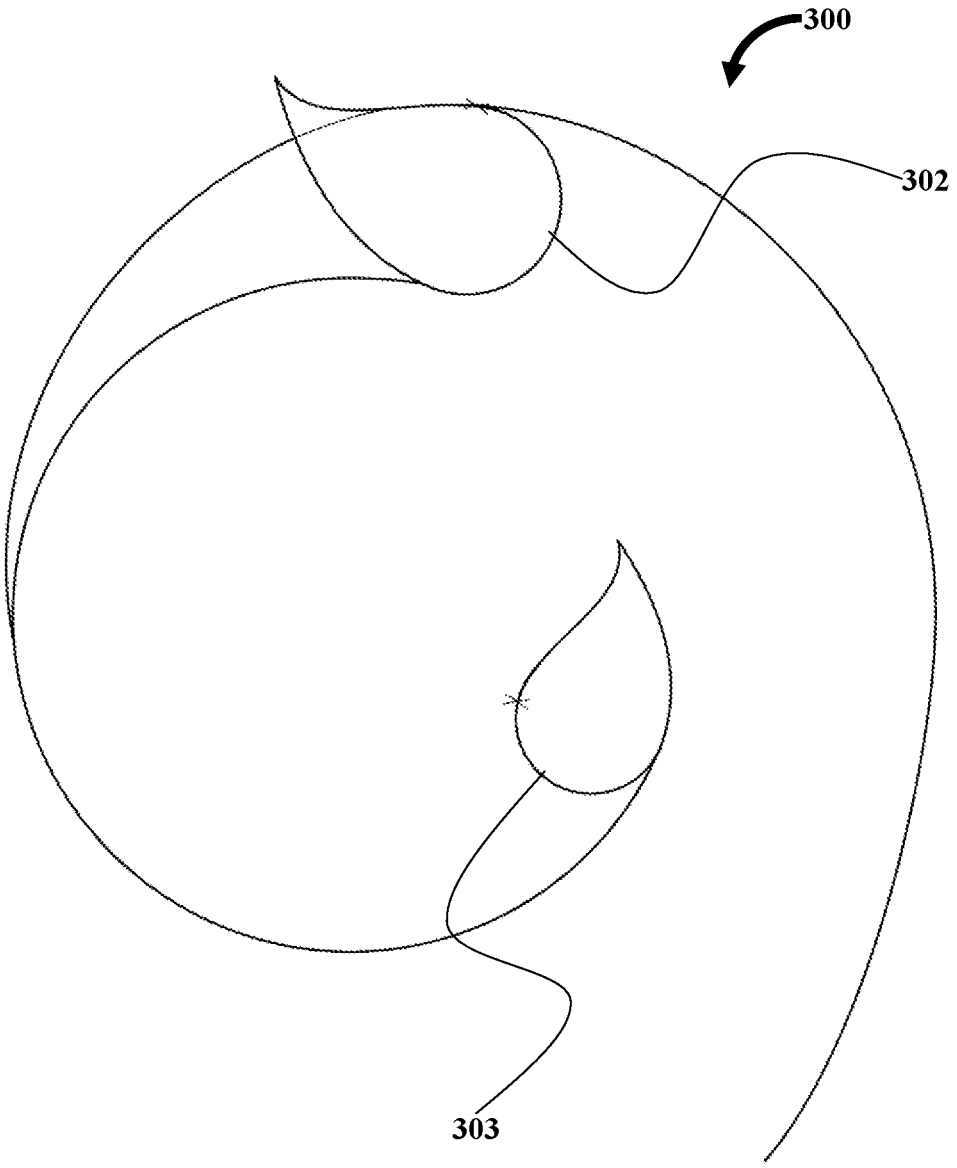
FIG. 3B exemplarily illustrates the continuation of the working example of the geometric divider as shown in FIG. 3A, showing the creation of curves to generate the Eslimi snake design.

FIG. 3A exemplarily illustrates a working example of the geometric divider 100, showing the construction of an Eslimi snake design 300 using circles 301, 302, and 303, and FIG. 3B exemplarily illustrates the continuation of working example of the geometric divider 100 as shown in FIG. 3A, showing the creation of curves to generate the Eslimi snake design 300.

The geometric divider may have a distance between the base brachium and the intersection of the third brachium on the dimension defines a second mouthpiece, wherein the second mouthpiece is configured to generate a length of the first portion of the equal portions to which the dimension is to be divided. The geometric divider may further comprise an intermediate linkage member configured to connect the first brachium and second brachium proximal to each distal end of the first brachium and second brachium. Each brachium may comprise one or more curved edges, wherein each curved edge is configured to be used by an artist to draw one of arced edges and arced surfaces.

The geometric divider may further comprise a third mouthpiece defined between distal ends of first brachium and second brachium, and a fourth mouthpiece defined between distal ends of the second brachium and the third brachium, wherein distances of the third mouthpiece and the first mouthpiece are configured to be in a golden proportion. In a related embodiment, the positioning of the third mouthpiece along a length of the dimension may generate a golden complement at the first mouthpiece, wherein the golden complement is a maximally opposing complement of the golden proportion.

In a working example of the usage of the geometric divider 100, the principle is as follows; the third mouthpiece 114 and the fourth mouthpiece 115 are in golden proportions relative to each other, or in other words, the ratio of the bigger part to the smaller part is equal to the total ratio to the bigger part. Thus, the third brachium 104 is pinned at position H1 on the slot 106 which is equal to '2'. Then by opening the third mouthpiece 114 at the size of a desired segment or the circle 301 as shown in FIG. 3A, it is possible to obtain the size of its golden complement at the fourth mouthpiece 115. This proportion is usable in different artistic and visual designs, for example, the Eslimi snake design 300. In one embodiment, it is possible to obtain the size of its golden complement at the first mouthpiece 109.

As shown in FIG. 3A, firstly, a circle 301 is drawn, and the first mouthpiece 109 is opened to enclose on the diameter of the circle 301. Now, mark on one-third of the base circle 301 by positioning the third brachium 104 in position '3' on the slot 106, and mark an arc 304. Draw a new circle 302 tangentially along the base circle 301 considering the perpendicular distance from the circumference of the base circle 301 and the arc 304 as the diameter. Another circle 303 is drawn in a similar manner considering one-fourth of the base circle 301. Now, corresponding curves extending from the circles 302 and 303 are projected to obtain the Eslimi snake design 300 as shown in FIG. 3B.

The geometric divider 100 allows an increase in the speed of artistic work, and at the same time increases the accuracy in designs. Working with the geometric divider 100 is relatively easy so that no mathematical formula and principle is required. The geometric divider 100 divides one dimension, or one size, into 2 to 10 equal parts immediately. Further, by repeated usage of the geometric divider 100, it is possible to divide the line to the desired extent. The geometric divider 100 allows to avoid usage of conventional tools such as rulers and calculators for dividing, allows to save time, and allows to work with Fibonacci golden proportions in designs.

Another aspect of the present disclosure is directed to a method to divide a dimension into equal portions. The method comprises providing a geometric divider, comprising: (i) a plurality of brachiums, a base brachium pivotally connecting to a first brachium at a first pivot and to a second brachium at a second pivot; (ii) a first groove positioned on the first brachium, and a second groove on the second brachium, wherein a third brachium is configured to slide across the first groove and the second groove, wherein corresponding distal ends of each brachium define a plurality of mouthpieces configured to measure the dimension; and (iii) a plurality of slots positioned on the first groove and the second groove, each slot numbered in arithmetic progression. The method further comprises enclosing a first mouthpiece defined by distal ends of the base brachium and the second brachium on the dimension. Further still, the method comprises selectively pinning the third brachium in a predetermined numbered slot on the first groove and the second groove, wherein the predetermined numbered slot determines the number of equal portions to which the dimension is to be divided; and dividing the dimension via an intersection of the third brachium on the dimension to generate a first portion of the equal portions of the dimension.

The method may further comprise defining a second mouthpiece between the base brachium and the intersection of the third brachium on the dimension, wherein the second mouthpiece is configured to generate a length of the first portion of the equal portions to which the dimension is to be divided. The method may further comprise an intermediate linkage member configured to connect the first brachium and second brachium proximal to each distal end of the first brachium and second brachium. Each brachium may comprise one or more curved edges, wherein each curved edge is configured to be used by an artist to draw one of arced edges and arced surfaces.

The method may further comprise a third mouthpiece defined between distal ends of first brachium and second brachium, and a fourth mouthpiece defined between distal ends of the second brachium and the third brachium, wherein distances of the third mouthpiece and the first mouthpiece are configured to be in a golden proportion. The method may further comprise positioning the third mouthpiece along a length of the dimension to generate a golden complement at the first mouthpiece, wherein the golden complement is a maximally opposing complement of the golden proportion.

The foregoing examples have been provided merely for the purpose of explanation and are in no way to be construed as limiting of the present concept disclosed herein. While the concept has been described with reference to various embodiments, it is understood that the words, which have been used herein, are words of description and illustration, rather than words of limitation.

Further, although the concept has been described herein with reference to particular means, materials, and embodiments, the concept is not intended to be limited to the particulars disclosed herein; rather, the concept extends to all functionally equivalent structures, methods and uses, such as are within the scope of the appended claims. Those skilled in the art, having the benefit of the teachings of this specification, may affect numerous modifications thereto and changes may be made without departing from the scope and spirit of the concept in its aspects.

The invention claimed is:

1. A geometric divider configured to divide a dimension into equal portions, geometric divider comprising:

a plurality of brachiums wherein the plurality comprises a first brachium, a second brachium, a third brachium and a base brachium, the base brachium pivotally connected to the first brachium at a first pivot and to the second brachium at a second pivot;

a first groove positioned on the first brachium, and a second groove on the second brachium, wherein the third brachium is configured to slide across the first groove and the second groove, wherein corresponding distal ends of each brachium define a plurality of first, second, third and fourth mouthpieces configured to measure the dimension; and a plurality of slots positioned on the first groove and the second groove, each slot numbered in arithmetic progression, wherein the first mouthpiece defined by distal ends of the base brachium and the first brachium is configured to enclose on the dimension, and the third brachium is configured to be selectively pinned in a predetermined numbered slot on the first groove and the second groove, wherein the predetermined numbered slot determines the number of equal portions to which the dimension is to be divided, and an intersection of the third brachium on the dimension divides the dimension to generate a first portion of the equal portions of the dimension.

2. The geometric divider of claim 1, wherein a distance between the base brachium and the intersection of the third brachium on the dimension defines the second mouthpiece, wherein the second mouthpiece is configured to generate a length of the first portion of the equal portions to which the dimension is to be divided.

3. The geometric divider of claim 1, further comprising an intermediate linkage member configured to connect the first brachium and the second brachium proximal to each distal end of the first brachium and the second brachium.

4. The geometric divider of claim 1, wherein each brachium comprises one or more curved edges, wherein each curved edge is configured to be used by an artist to draw one of arced edges and arced surfaces.

5. The geometric divider of claim 1, further comprising the third mouthpiece defined between distal ends of the first brachium and the second brachium, and the fourth mouthpiece defined between distal ends of the second brachium and the third brachium, wherein distances of the third mouthpiece and the fourth mouthpiece are configured to be in a golden proportion.

6. The geometric divider of claim 5, wherein the positioning of the third mouthpiece along a length of the dimension generates a golden complement with the fourth mouthpiece, wherein the golden complement is a maximally opposing complement of the golden proportion.

7. A method to divide a dimension into equal portions, the method comprising:

providing a geometric divider, comprising:

a plurality of brachiums wherein the plurality comprises a first brachium, a second brachium, a third brachium and a base brachium, the base brachium pivotally connecting to the first brachium at a first pivot and to the second brachium at a second pivot;

a first groove positioned on the first brachium, and a second groove on the second brachium, wherein the third brachium is configured to slide across the first groove and the second groove, wherein corresponding distal ends of each brachium define a plurality of first, second, third and fourth mouthpieces configured to measure the dimension; and a plurality of slots positioned on the first groove and the second groove, each slot numbered in arithmetic progression;

enclosing the first mouthpiece defined by distal ends of the base brachium and the second brachium on the dimension;

selectively pinning the third brachium in a predetermined numbered slot on the first groove and the second groove, wherein the predetermined numbered slot determines the number of equal portions to which the dimension is to be divided; and dividing the dimension via an intersection of the third brachium on the dimension to generate a first portion of the equal portions of the dimension.

8. The method of claim 7, further comprising defining the second mouthpiece between the base brachium and the intersection of the third brachium on the dimension, wherein the second mouthpiece is configured to generate a length of the first portion of the equal portions to which the dimension is to be divided.

9. The method of claim 7, further comprising an intermediate linkage member configured to connect the first brachium and the second brachium proximal to each distal end of the first brachium and the second brachium.

10. The method of claim 7, wherein each brachium comprises one or more curved edges, wherein each curved edge is configured to be used by an artist to draw one of arced edges and arced surfaces.

11. The method of claim 7, further comprising the third mouthpiece defined between distal ends of the first brachium and the second brachium, and the fourth mouthpiece defined between distal ends of the second brachium and the third brachium, wherein distances of the third mouthpiece and the first mouthpiece are configured to be in a golden proportion.

12. The method of claim 11, further comprising positioning the third mouthpiece along a length of the dimension to generate a golden complement at the first mouthpiece, wherein the golden complement is a maximally opposing complement of the golden proportion.

* * * * *